US009637145B2

(12) United States Patent
Brandstaetter et al.

(10) Patent No.: US 9,637,145 B2
(45) Date of Patent: May 2, 2017

(54) RAIL VEHICLE WITH ROLL STABILIZER

(71) Applicant: SIEMENS AKTIENGESELLSCHAFT, Munich (DE)

(72) Inventors: Christian Brandstaetter, Graz (AT); Gerhard Kaserer, Gratkorn (AT); Christian Plankensteiner, Doelsach (AT); Michael Sumnitsch, Graz (AT)

(73) Assignee: Siemens AG Oesterreich, Vienna (AT)

( * ) Notice: Subject to any disclaimer, the term of this patent is extended or adjusted under 35 U.S.C. 154(b) by 135 days.

(21) Appl. No.: 14/413,599

(22) PCT Filed: Jun. 25, 2013

(86) PCT No.: PCT/EP2013/063231

§ 371 (c)(1),
(2) Date: Jan. 8, 2015

(87) PCT Pub. No.: WO2014/009142

PCT Pub. Date: Jan. 16, 2014

(65) Prior Publication Data

US 2015/0135985 A1 May 21, 2015

(30) Foreign Application Priority Data

Jul. 9, 2012 (AT) ..... A50275/2012

(51) Int. Cl.
*B61F 5/24* (2006.01)
*B61F 5/22* (2006.01)

(52) U.S. Cl.
CPC . *B61F 5/24* (2013.01); *B61F 5/22* (2013.01)

(58) Field of Classification Search
CPC ..... B61F 5/24; B61F 5/22; B61F 5/02; B61F 5/38; B61F 5/44; B61F 1/14; B61F 5/30
See application file for complete search history.

(56) References Cited

U.S. PATENT DOCUMENTS 4,324,187 A * 4/1982 Sambo ..... B60G 21/055 105/164
8,356,557 B2 1/2013 Schneider
(Continued)

FOREIGN PATENT DOCUMENTS

CN 1345673 A 4/2002
CN 102448790 A 5/2012
(Continued)

*Primary Examiner* — Mark Le
(74) *Attorney, Agent, or Firm* — Laurence Greenberg; Werner Stemer; Ralph Locher

(57) ABSTRACT

A rail vehicle includes at least one running gear and at least one anti-roll stabilizer which is connected to two different vehicle parts of the rail vehicle. The anti-roll stabilizer includes a torsion shaft disposed on a vehicle part transversally to the longitudinal direction of the vehicle, levers anti-rotationally disposed on the torsion shaft at both sides of the longitudinal axis of the vehicle and a respective draw/push rod for each lever. Each lever is articulatingly connected to one end of the draw/push rod and the draw/push rod is articulatingly connected at its other end to the other vehicle part. In order to reduce the dynamic forces on the draw/push rods in the oblique configuration thereof, imaginary extensions of the draw/push rods intersect at a point which lies approximately on the axis of rotation of the outward rotational movement of the running gear.

5 Claims, 3 Drawing Sheets

(56) References Cited

U.S. PATENT DOCUMENTS

| | | | |
|---|---|---|---|
| 8,910,579 | B2 | 12/2014 | Schneider |
| 2002/0035947 | A1 | 3/2002 | Sebata et al. |

FOREIGN PATENT DOCUMENTS

| | | | |
|---|---|---|---|
| CN | 102498024 | A | 6/2012 |
| DE | 2839904 | | 3/1980 |
| DE | 4410970 | C1 | 7/1995 |
| DE | 202009015735 | U1 | 4/2010 |
| DE | 202009015736 | U1 | 4/2010 |
| EP | 0699149 | A1 | 3/1996 |
| EP | 1190925 | A1 | 3/2002 |
| RU | 2376181 | C2 | 12/2009 |
| WO | 9526291 | A1 | 10/1995 |
| WO | 2010113045 | A2 | 10/2010 |

* cited by examiner

RAIL VEHICLE WITH ROLL STABILIZER

TECHNICAL FIELD

Background of the Invention

Field of the Invention

The invention relates to a rail vehicle having at least one set of running gear and having at least one anti-roll stabilizer which is connected to two different parts of the rail vehicle, wherein the anti-roll stabilizer comprises

- a torsion shaft disposed on a vehicle part transversely to the longitudinal direction of the vehicle,
- levers non-rotationally mounted thereon on both sides of the longitudinal axis of the vehicle,
- a draw/push bar for each lever, wherein each lever is articulately connected to one end of the draw/push bar, the other end thereof being articulately connected to the other vehicle part.

The one vehicle part is generally the running gear, i.e. the wheel truck (bogie) or wheel truck frame, the other vehicle part is the vehicle body. A rail vehicle generally has at least two sets of running gear.

Prior Art

In rail vehicles—but also in other vehicles—the vehicle body is generally resiliently mounted with respect to the wheel units, e.g. wheel pairs or wheelsets, via one or more spring stages. Because of the comparatively high center of gravity of the vehicle body, when the vehicle is negotiating a bend, the centrifugal acceleration occurring, acting transversely to the direction of travel and therefore transversely to the vehicle's longitudinal axis, makes the vehicle body tend to tilt toward the outside of the bend with respect to the wheel units, i.e. to perform a rolling motion about a roll axis parallel to the vehicle's longitudinal axis. On the one hand, such rolling is above acceptable limits for passenger comfort. On the other, it risks fouling the clearance gauge and, in terms of derailment security, it can cause impermissible unilateral wheel unloading.

In order to prevent this, anti-roll devices in the form of anti-roll stabilizers are generally used. These are designed to present a resistance to the rolling movement of the vehicle body in order to reduce it, while not preventing the lifting and bouncing movement of the vehicle body relative to the wheel units, i.e. the running gear. Such anti-roll stabilizers are known in various hydraulically or purely mechanically operating designs. A torsion shaft extending at, right angles to the longitudinal axis of the vehicle is frequently used, as disclosed, for example, in EP 1 075 407 B1 or DE 24 21 874 A1.

Levers extending in the longitudinal direction of the vehicle are anti-rotationally mounted, on this torsion shaft on both sides of the vehicle's longitudinal axis. These levers are in turn connected to guide rods or the like which are disposed kinematically parallel to the vehicle's spring devices. When the vehicle's spring devices are compressed, the levers on the torsion shaft are set in rotary motion, via the guide rods connected to them. If rolling occurs with different spring excursions of the spring devices on either side of the vehicle as it negotiates a bend, this produces different rotation angles of the levers mounted on the torsion shaft. The torsion shaft is accordingly subject to a torque which—depending on its torsional stiffness—it equalizes at a particular torsion angle by a counter-torque resulting from its plastic deformation and this prevents further rolling. In the case of rail vehicles equipped with wheel trucks, the anti-roll device can be provided not only for the secondary spring stage, i.e. act between a running gear frame and the vehicle body. The anti-roll device can also be used in the primary stage, i.e. act between the wheel units and a running gear frame or—in the absence of secondary suspension—a vehicle body.

The anti-roll stabilizer is designed both for single-wheel running gear and for single-axle running gear, i.e. running gear having a single wheelset, and also for wheel trucks. The term running gear denotes the part of a rail vehicle on which the vehicle runs and is guided on the rails. The term wheel truck (bogie) denotes running gear comprising two or more wheelsets disposed in a frame. The component parts of a wheel truck include the primary suspension and possibly a secondary suspension. The term primary suspension denotes the suspension between the wheel truck frame and the wheelsets. In the case of wheel trucks having two-stage suspension, the secondary suspension is used as a second suspension stage for cushioning the vehicle body against the wheel truck frame.

In the known publications, the draw/push bars or guide rods are disposed vertically for maximum decoupling of the movements. However, a vertical arrangement of this kind is sometimes impossible or undesirable for design reasons. If the vehicle's longitudinal axis is defined as the x-axis of a rectangular coordinate system, the transverse direction of the vehicle as the y-axis and the vertical direction of the vehicle as the z-axis, the draw/push bars could be angled with respect to the vertical direction, such that they—considered as a projection into the y-z or x-z plane—appear tilted in at least one projection. However, in addition to a coupling of movements in the case of an unfavorable arrangement this also results in higher dynamic forces in the draw/push bars when the vehicle is negotiating a bend and in higher rotational resistances of the running gear.

The rotational resistance is the force with which the running gear opposes outward rotation. It is a measure of the freedom of movement of wheel trucks or running gear. The running gear's axis of rotation about which the wheel truck can rotate relative to the superstructure is parallel to the z-axis defined above. The rotational resistance can be measured by means of a turntable which, turns the running gear to the left and to the right by means of hydraulic cylinders. Using this process, the rotational resistance is measured as a function of the rotation angle via a load cell on the hydraulic cylinder.

SUMMARY OF THE INVENTION

The object of the present invention is therefore to provide an anti-roll stabilizer which brings about a reduction in the dynamic forces acting on the draw/push bars when they are disposed at an angle and prevents an increase in the rotational resistance of the running gear.

This object is achieved by a rail vehicle with anti-roll stabilizer having the features set forth in an independent claim. Advantageous embodiments of the invention are defined in the respective dependent claims.

It is provided that, in at least one loading state of the vehicle, the imaginary extensions of the two draw/push bars intersect—ideally—at a point which is—precisely or approximately—on the axis of rotation of the outward rotational movement of the running gear. This axis of rotation is usually in the geometric center of the running gear. The draw/push bars are normally the same distance away from this point.

In most cases the vehicle part which is connected to the anti-roll stabilizer is the running gear, and the other vehicle part is the vehicle body.

In the special but usual case of a mirror-symmetrical arrangement of the draw/push bars in respect of the x-z plane, each draw/push bar, or more precisely its central longitudinal axis, is therefore a sub-segment of a generating line of an imaginary circular cone whose apex is ideally on the axis of rotation of the outward rotational movement of the running gear.

In the present invention, the draw/push bars of the anti-roll stabilizer generally enclose an angle with the vertical not only with respect to a transverse plane running at right-angles to the vehicle's longitudinal axis (the y-z plane according to the above definition), but also in a perpendicular plane along the vehicle (the x-z plane according to the above definition).

It has been shown that, with the inventive arrangement of the draw/push bars, a reduction in the maximum dynamic forces acting at draw/push bar level in the draw/push bars is possible if the maximum forces result from scenarios which include outward rotation of the running gear. As a result, the draw/push bars and their articulations achieve a longer service life and possibly need to be replaced less often.

The arrangement according to the invention is independent of whether the torsion shaft is mounted on the running gear or on the vehicle body, whether the draw/push, bars are inclined upward or downward, and whether the point of intersection of the imaginary extension of the draw/push bars is below or above the anti-roll system.

The arrangement according to the invention is not limited to one anti-roll system. A plurality of anti-roll systems, i.e. a plurality of anti-roll stabilizers, can be present for each set of running gear, wherein all the anti-roll stabilizers of a set of running gear can be disposed on a vehicle body, or even on separate vehicle bodies. The imaginary extension of the draw/push, bars of different anti-roll stabilizers possibly have no common point of intersection, as defined above, with the axis of rotation of the outward rotational movement of the running gear.

In a possible application of the invention, at least two anti-roll stabilizers are provided for each set of running gear. (several pairs of anti-roll stabilizers could also be provided, however), the torsion shafts of which are disposed in parallel and where, in at least one loading state of the vehicle, the imaginary extensions of all the draw/push bars intersect at a point which is approximately on the axis of rotation of the outward rotational movement of the running gear. The draw/push bars are therefore arranged mirror-symmetrically with respect to the y-z plane and x-z plane as defined above. All four draw/push bars are therefore on a cone envelope common to all the draw/push bars, wherein the height axis of the cone coincides with the axis of rotation of the outward rotational movement of the running gear.

In practice, during operation of the rail vehicle, the inventive arrangement of the draw/push bars is normally only in place in the event of a particular loading of the rail vehicle. This is because different compression of the suspension takes place depending on the loading, resulting in different angling of the draw/push bars. As the largest forces in the draw/push bars usually occur when the vehicle is fully loaded, this state is an ideal candidate for the inventive geometric arrangement of the draw/push bars. However, another state, e.g. the empty state of the vehicle body, in which the draw/push bars assume the inventive position could equally be selected.

The angling of the draw/push bars, i.e. their inclination with respect to the axis of rotation of the outward rotational movement, is generally between 2° and 10°. If a draw/push bar is therefore projected into the y-z plane and/or x-z plane, in therefore includes an angle of between 2° and 10° with the z-direction.

The inventive arrangement of the draw/push bars also fulfills its purpose if the arrangement is slightly at variance with the ideal arrangement, i.e. if the imaginary extensions of the draw/push bars of an anti-roll stabilizer do not exactly meet at a point, or rather this point of intersection does not lie exactly on the axis of rotation.

The inventive arrangement of the draw/push bars can also be applied to secondary vertical dampers, even if there the reduction of the forces in the secondary vertical dampers is of lesser importance.

BRIEF DESCRIPTION OF THE DRAWINGS

For further explanation of the invention, reference will be made in the following part of the description to the accompanying drawings which illustrate further advantageous embodiments, details and further development of the invention, in which.

DESCRIPTION OF PREFERRED EMBODIMENTS

Figure 1:
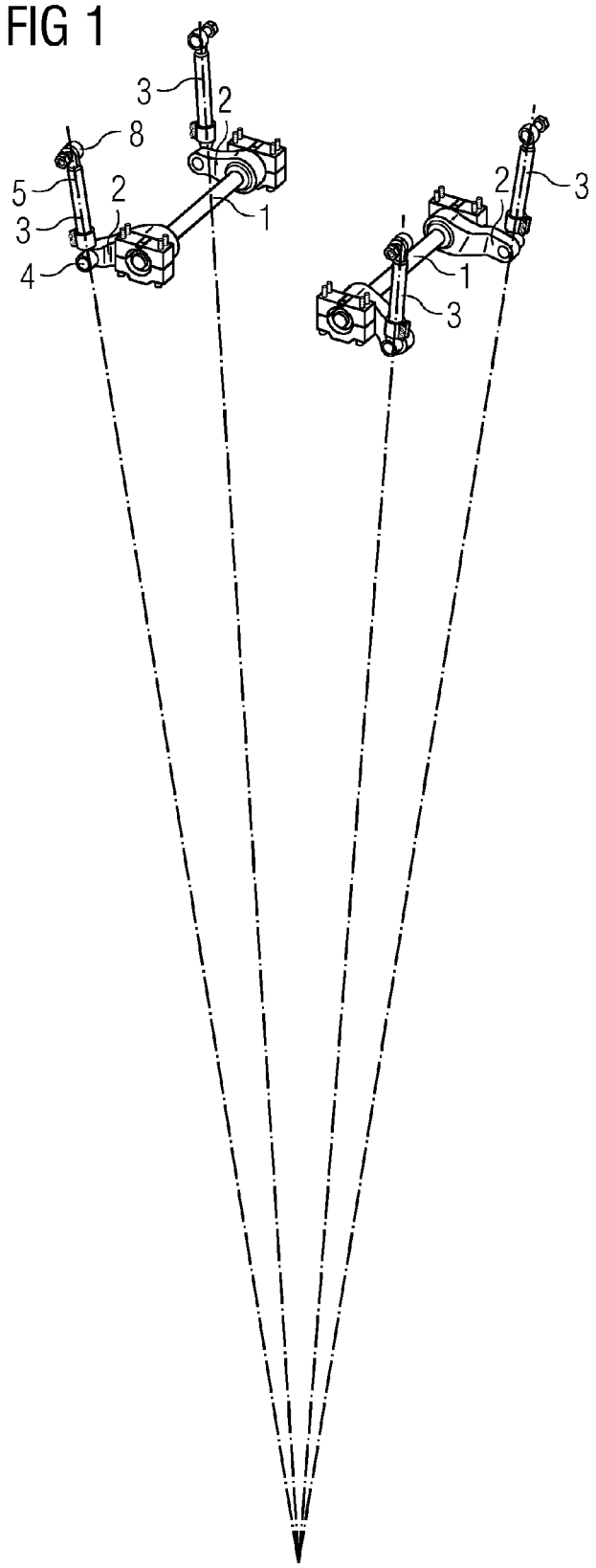
FIG. 1 shows a perspective view of two anti-roll stabilizers for a running gear.

FIG. 1 shows two anti-roll stabilizers according to the invention which are installed in a rail vehicle. To better describe the invention, the other parts of the rail vehicle are not shown.

Each anti-roll stabilizer has a torsion shaft 1 with a lever 2 disposed at each end. In a rectangular coordinate system having an x-axis parallel to vehicle's longitudinal axis, a y-axis in the transverse direction of the vehicle and a z-axis in the vertical direction of the vehicle, the torsion shaft 1 is disposed parallel to the y-axis, whereas the levers 2 are parallel to the x-axis.

The four draw/push bars 3 are articulately connected at one end to the free end of the lever 2 by means of a spherical joint 4 in each case. At the other end, the draw/push bars 3 are each connected via another spherical joint 8 to the vehicle body or running gear (not shown). The draw/push bars 3 enclose an angle with the z-direction both in the y-direction and in the x-direction by their—here upper—end being inclined away from the lever 2. If the z-axis of the rectangular coordinate system is defined such that it intersects the vehicle's longitudinal axis precise centrally between the two torsion shafts 1, the inclination of the draw/push bars 3 must be inventively set such that the dash-dotted extensions of the four draw/push bars 3—here below the anti-roll stabilizers in the case of FIG. 1—intersect at a common point, on the z-axis. Because of the mirror-symmetrical arrangement with respect to the y-z plane and x-z plane, the draw/push bars 3 are therefore on the surface of a straight circular cone, i.e. having a circular base and an axis at right, angles thereto. The axis of the circular cone is on the z-axis, its apex below the draw/push bars 3.

With the same arrangement of the torsion shafts 1 and the levers 2, it would also be possible for the draw/push bars 3 to be inclined toward the z-axis at their ends facing away from the lever 2, so that the apex of the circular cone is above the anti-roll stabilizers.

Figure 2:
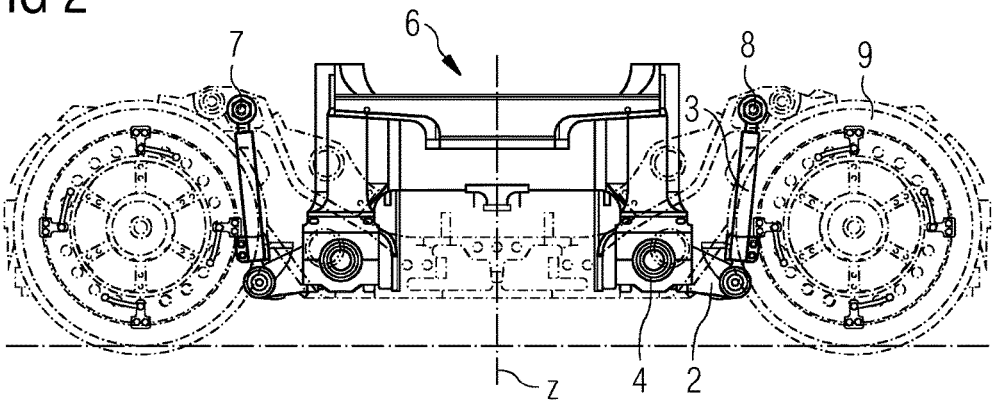
FIG. 2 shows a side view in the transverse direction of running gear having two anti-roll stabilizers according to the invention.
Figure 3:
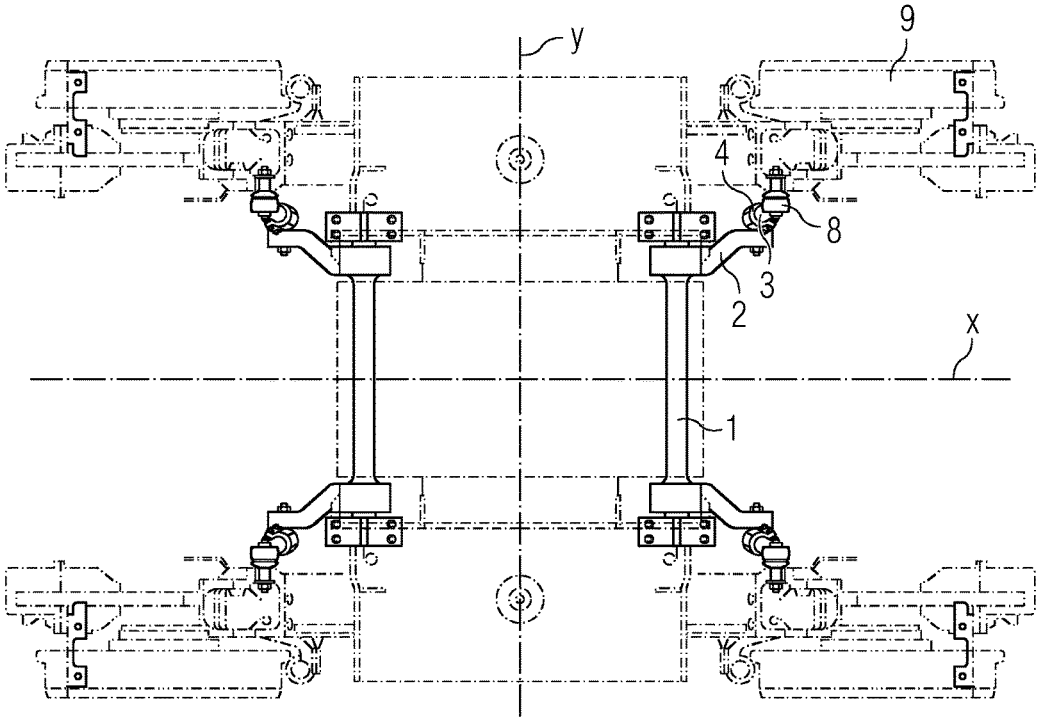
FIG. 3 shows a plan view onto the running gear from FIG. 2.
Figure 4:
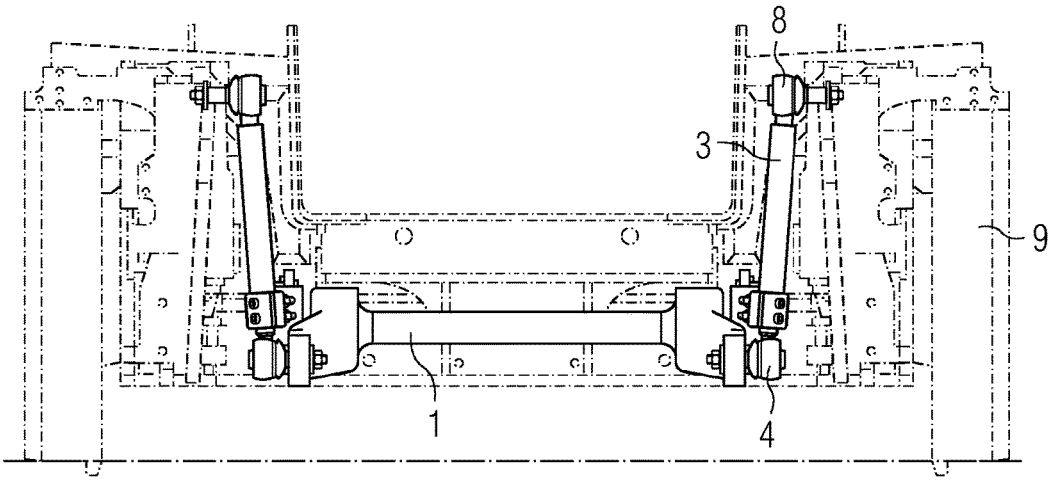
FIG. 4 shows a side view in the longitudinal direction of the running gear from FIG. 2.

FIGS. 2-4 show running gear 6 having inventive anti-roll stabilizers according to FIG. 1. The running gear 6 comprises among other things the bearings for the wheels 9. The torsion shafts 1 are mounted on the vehicle body 7, they run in the vehicle's transverse direction (parallel to the y-axis). The two anti-roll stabilizers are disposed in a mirror-image manner with respect to the y-z plane, each anti-roll stabilizer being additionally implemented in a mirror-image manner with respect to the x-z plane. The anti-roll stabilizers are connected to the wheel truck 6 on the one hand and to the vehicle body 7 on the other.

In FIG. 3 shows a plan view onto the anti-roll stabilizers from FIG. 1 along the z-axis. The z-axis is here the point at which the dash-dotted x-axis intersects the y-axis. The z-axis corresponds to the axis of rotation of the outward, rotational movement of the running gear 6.

However, the running gear of FIGS. 2-4 could also have further anti-roll stabilizers between running gear 6 and vehicle body 7. The imaginary extensions of the two draw/push bars of another anti-roll stabilizer could then intersect at a different point on the axis of rotation from that of the two anti-roll stabilizers shown.

Self-evidently, articulations other than spherical joints could also be used to implement the invention. The spherical joints 8 or other joints at the end 5 of the draw/push bars 3 can also engage via other devices such as spring or damper devices on the vehicle body.

LIST OF REFERENCE CHARACTERS

1 torsion shaft
2 lever
3 draw/push bar
4 spherical joint between, lever 2 and draw/push bar 3
5 end of draw/push bar 3
6 running gear
7 vehicle body
8 spherical joint at end 5 of draw/push bar 3
9 wheel
x longitudinal axis of vehicle (x-axis)
y transverse direction (y-axis)
z vertical direction (z-axis)

The invention claimed is:

1. A rail vehicle, comprising:
a vehicle body;
a longitudinal vehicle axis and a longitudinal vehicle direction;
at least one running gear experiencing an outward rotational movement having an axis of rotation; and
at least two anti-roll stabilizers connected to said running gear and said vehicle body, each of said at least two anti-roll stabilizers including:
a torsion shaft disposed on one of said running gear or said vehicle body and extending transverse to said longitudinal vehicle direction;
levers anti-rotationally mounted on said torsion shaft along said longitudinal vehicle axis; and
draw/push bars each having one end articulatingly connected to a respective one of said levers and another end articulatingly connected to the other of said vehicle parts;
said draw/push bars having imaginary extensions intersecting at a point lying on said axis of rotation of said outward rotational movement of said running gear, in at least one loading state of the vehicle.

2. The rail vehicle according to claim 1, wherein said loading state is full load.

3. The rail vehicle according to claim 1, wherein said draw/push bars are disposed at an angle of between 2° and 10°.

4. A rail vehicle, comprising:
a longitudinal vehicle axis and a longitudinal vehicle direction;
at least one running gear experiencing an outward rotational movement having an axis of rotation; and
a plurality of different anti-roll stabilizers provided for each running gear and connected to two different vehicle parts of the rail vehicle, each said plurality of different anti-roll stabilizers including:
a torsion shaft disposed on one of said vehicle parts and extending transverse to said longitudinal vehicle direction;
levers anti-rotationally mounted on said torsion shaft along said longitudinal vehicle axis; and
draw/push bars each having one end articulatingly connected to a respective one of said levers and another end articulatingly connected to the other of said vehicle parts;
said draw/push bars having imaginary extensions intersecting at a point lying on said axis of rotation of said outward rotational movement of said running gear and said imaginary extensions intersect said axis of rotation of said outward rotational movement of said running gear at different points, in at least one loading state of the vehicle.

5. A rail vehicle, comprising:
a longitudinal vehicle axis and a longitudinal vehicle direction;
at least one running gear experiencing an outward rotational movement having an axis of rotation; and
at least two anti-roll stabilizers provided for each running gear and connected to two different vehicle parts of the rail vehicle, each said at least two anti-roll stabilizers including:
a torsion shaft disposed on one of said vehicle parts and extending transverse to said longitudinal vehicle direction where said torsion shafts of said anti-roll stabilizers are disposed in parallel;
levers anti-rotationally mounted on said torsion shaft along said longitudinal vehicle axis; and
draw/push bars each having one end articulatingly connected to a respective one of said levers and another end articulatingly connected to the other of said vehicle parts;
said draw/push bars having imaginary extensions intersecting at a point lying on said axis of rotation of said outward rotational movement of said running gear where said imaginary extensions of all of said draw/push bars of said anti-roll stabilizers intersect at a point lying on said axis of rotation of said outward rotational movement of said running gear, in at least one loading state of the vehicle.

* * * * *